US008904568B2

(12) United States Patent
Fruscione-Loizides

(10) Patent No.: US 8,904,568 B2
(45) Date of Patent: Dec. 9, 2014

(54) CLOTHING SUPPORT SYSTEM

(75) Inventor: Gia Fruscione-Loizides, Skillman, NJ (US)

(73) Assignee: Thinking Tiger, LLC, Skillman, NJ (US)

( * ) Notice: Subject to any disclaimer, the term of this patent is extended or adjusted under 35 U.S.C. 154(b) by 260 days.

(21) Appl. No.: 13/531,784

(22) Filed: Jun. 25, 2012

(65) Prior Publication Data

US 2013/0344772 A1 Dec. 26, 2013

(51) Int. Cl.
*A41F 9/02* (2006.01)
*A41F 9/00* (2006.01)

(52) U.S. Cl.
USPC ..... 2/312; 2/311; 450/155

(58) Field of Classification Search
USPC ..... 450/155; 2/310–312, 338, 107, 217, 2/223, 240, 300, 301, 304, 306–309, 318, 2/319, 321–323; 128/96.1, 99.1, 44, 45, 128/98.1, 100.1, 101, 1
See application file for complete search history.

(56) References Cited

U.S. PATENT DOCUMENTS 2,265,662 A * 12/1941 Marshall ..... 450/136
3,273,563 A 9/1966 Bonang ..... 450/155
4,557,268 A 12/1985 Maddux et al. ..... 128/579
4,596,253 A * 6/1986 Griffith ..... 450/155
4,952,192 A 8/1990 Burke ..... 450/15
5,217,403 A 6/1993 Nobbs ..... 450/155
6,071,175 A * 6/2000 Working, III ..... 450/155
6,159,070 A 12/2000 Schwartz et al.
6,620,026 B1 9/2003 Guilani et al. ..... 450/155
7,008,292 B2 * 3/2006 Cosentino et al. ..... 450/155
7,101,348 B2 9/2006 Garth et al. ..... 128/101.1
7,704,121 B2 4/2010 Goodman ..... 450/155

* cited by examiner

*Primary Examiner* — Gloria Hale
(74) *Attorney, Agent, or Firm* — Roberts & Roberts, LLP

(57) ABSTRACT

A clothing support system is provided, which includes a clothing support article for providing support to a portion of a user's body. The clothing support article has front and rear panels of a substantially non-elastic fabric, for the support of a portion of the user's body. The front and rear panels are attached together by first and second side panels, which include a fabric of two-way elasticity which is stretchable between the front and rear panels. The clothing support system may further include a tension strap having a central support portion and two ends which are attachable to the front panel, to thereby provide enhanced support to a user's body. A method for providing support to a user's body is also provided, wherein tension is applied to the tension strap of the clothing support system.

20 Claims, 4 Drawing Sheets

CLOTHING SUPPORT SYSTEM

BACKGROUND OF THE INVENTION

1. Field of the Invention

The present invention relates to support articles including support garments, and more particularly to a clothing support system for providing bodily support. The clothing support system may be incorporated into support garments such as maternity support garments, therapeutic support garments, and the like.

2. Description of the Related Art

Various types of support articles have been designed to provide maternity support, therapeutic support and the like. Conventional support garments are often provide only a single level of support, and those with adjustable components are often bulky and uncomfortable. In addition, many support garments are offered the form of undergarments, which are disadvantageous in that they require frequent laundering and/or the purchase of multiple garments. U.S. Pat. No. 3,273,563 relates to an under-belly maternity girdle for shifting abdominal weight to the back region via a main supporting strap 9. However, this configuration reaches over shoulders and adjusts in the rear of the individual, which poses a problem when wearing and adjusting the garment independently. U.S. Pat. No. 4,952,192 provides a belt-based system attached to an upper harness which is attached to a user's shoulders. Such articles are uncomfortable and inconvenient for an active lifestyle. U.S. Pat. No. 4,557,268 provides an undergarment having two belts attached in the rear of the article, which extend forward to the front of the garment. The belts are formed of an elastic material encased in a fixed material. Again, these undergarments must be frequently laundered. U.S. Pat. No. 5,217,403 provides an undergarment with a front panel having attachments such that the front panel can be stretched and attached to the rear of the article. However, adjustment of this arrangement is inconvenient and difficult since the attachments are in the rear of the article. As stated above, such undergarments require frequent laundering. U.S. Pat. No. 6,620,026 provides such an undergarment having left and right elastic bands or belts which are wrapped around a user's body and joined in the front of the undergarment. It is noted that this arrangement limits the article's adjustability as the belt is affixed to the back of the undergarment. U.S. Pat. No. 7,101,348 provides a complex and bulky brace system with multiple detachable front panels, cables, and pull tabs. Such a device would not be easily incorporated into a support garment such as a pair of pants. U.S. Pat. No. 7,704,121 relates to a one-piece, single-stage support which contains two parallel belts which wrap around a user from back to front. Their article is entirely made of an elastic material, and serves to provide a counter rotation of the pelvis.

It is clear that a need exists in the art for a support article which provides varying levels of support as needed, and which is easily adjustable by a user. It would be desirable to provide a support article which is non-bulky, comfortable and breathable. It would further be desirable to provide a support article which may be easily incorporated into a clothing article such as pants or the like, and does not require frequent laundering such as with undergarments.

The present invention solves these problems by providing a specially designed clothing support system which has the advantage of providing multiple levels of support, wherein a user has an opportunity to increase or decrease the support by adding the tension strap to the clothing support article, or removing the tension strap from the clothing support article. Key features of this invention are the front and rear panels which are formed of fabrics of a substantially non-stretch material, thus providing front and rear support via spring action with two laterally stretchable side panels attached thereto. Another key feature of the invention is the presence of a rear engagement component which serves as a pivot point for engagement of the tension strap. This allows tension to be applied via the tension strap to a portion of a user's body, thus providing enhanced support when needed. The materials of the invention are of lightweight, resilient materials which provide a comfortable fit to a user without being bulky or restrictive.

U.S. Pat. No. 6,071,175 provides the closest related art. This reference describes a natal/abdominal support article having a support member (4) wrapped in an apron (6), which apron wraps around a user from back to front. A further strap (8) is placed over the top of a user's belly. However, it is noted that the support member merely provides a passive attachment point for the apron, while the tension strap of the present invention forms a tensioned attachment providing uplifting support due to its engagement with the rear engagement component. In contrast, the support provided by the article of the reference is provided by its apron (6). The active support portion of their device is in the rear of the individual coming forward, whereas the present structure offers circumferential support in addition to a front-to-back-to-front active second level. In fact, U.S. Pat. No. 7,101,348 listed above specifically states that supports such as that from U.S. Pat. No. 6,071,175 are not easily adjustable since the back and side portions of the support are fixedly coupled to the front portion. Thus, while U.S. Pat. No. 6,071,175 offers a multi-component support structure, the present invention offers a more desirable structure which is more easily adjustable and thus offers better support.

The inventive clothing support system is a clear improvement over what is known and currently used in the art. The invention may be used for various purposes such as maternity support, obesity support, injury support, or therapeutic support, among others. In addition, the invention may further be used for preventative purposes, such as providing support to prevent injury.

SUMMARY OF THE INVENTION

The invention provides a clothing support system, comprising a clothing support article which comprises:

a) a front panel having an outer surface, an inner surface, a top edge, a bottom edge, a first side edge and a second side edge, said front panel comprising a substantially non-elastic fabric, and which front panel outer surface comprises an attachment component;

b) a rear panel having an outer surface, an inner surface, top edge, a bottom edge, a first side edge and a second side edge, said rear panel comprising a substantially non-elastic fabric, and which rear panel outer surface comprises a rear engagement component; and c) a first side panel attached to the first side edge of the front panel and attached to the first side edge of the rear panel; a second side panel attached to the second side edge of the front panel and attached to the second side edge of the rear panel; said first side panel and second side panel each comprising a fabric of two-way elasticity which is laterally stretchable between the front panel and the rear panel.

In certain embodiments, the clothing support system further comprises a tension strap having a first end, a second end, and a central support portion which tension strap comprises a substantially non-elastic fabric; the first end of the tension strap having an attachment component, and the second end of the tension strap having an attachment component; the tension strap being capable of engaging the rear engagement component of the rear panel; the first end attachment component and second end attachment component of the tension strap each being capable of attachment to the attachment component of the front panel.

The invention also provides a method of providing support to a portion of a user's body, comprising the steps of:

I) providing a clothing support system, comprising a clothing support article which comprises:
   a) a front panel having an outer surface, an inner surface, a top edge, a bottom edge, a first side edge and a second side edge, said front panel comprising a substantially non-elastic fabric, and which front panel outer surface comprises an attachment component;
   b) a rear panel having an outer surface, an inner surface, top edge, a bottom edge, a first side edge and a second side edge, said rear panel comprising a substantially non-elastic fabric, and which rear panel outer surface comprises a rear engagement component; and
   c) a first side panel attached to the first side edge of the front panel and attached to the first side edge of the rear panel; a second side panel attached to the second side edge of the front panel and attached to the second side edge of the rear panel; said first side panel and second side panel each comprising a fabric of two-way elasticity which is laterally stretchable between the front panel and the rear panel;

II) providing a tension strap having a first end, a second end, and a central support portion which tension strap comprises a substantially non-elastic fabric; the first end of the tension strap having an attachment component, and the second end of the tension strap having an attachment component; the tension strap being capable of engaging the rear engagement component of the rear panel; the first end attachment component and second end attachment component of the tension strap each being capable of attachment to the attachment component of the front panel;

III) placing the central support portion of the tension strap against a user's body, IV) engaging the tension strap with the rear engagement component of the rear panel; and V) applying tension to the tension strap, and attaching the first end attachment component and second end attachment component of the tension strap to the front panel attachment component, thereby providing support to at least a portion of the user's body.

The invention further provides a clothing support system, comprising a clothing support article which comprises:

a) a front panel having an outer surface, an inner surface, a top edge, a bottom edge, a first side edge and a second side edge, said front panel comprising a substantially non-elastic fabric, and which front panel outer surface comprises an attachment component;

b) a rear panel having an outer surface, an inner surface, top edge, a bottom edge, a first side edge and a second side edge, said rear panel comprising a substantially non-elastic fabric, and which rear panel outer surface comprises a rear engagement component;

c) a first side panel attached to the first side edge of the front panel and attached to the first side edge of the rear panel; a second side panel attached to the second side edge of the front panel and attached to the second side edge of the rear panel; said first side panel and second side panel each comprising a fabric of two-way elasticity which is laterally stretchable between the front panel and the rear panel; and d) an upper covering panel attached to the top edge of the front panel and/or the top edge of the rear panel;

wherein the attachment component of the front panel comprises hook-and-loop fasteners;

wherein the rear engagement component of the rear panel comprises hook-and-loop fasteners;

wherein the front panel and the rear panel each independently comprise a substantially non-elastic fabric comprising cotton; and wherein the first side panel and the second side panel each independently comprise a fabric of two-way elasticity which is laterally stretchable, said fabric comprising elastic.

DETAILED DESCRIPTION OF THE INVENTION

Figure 4:
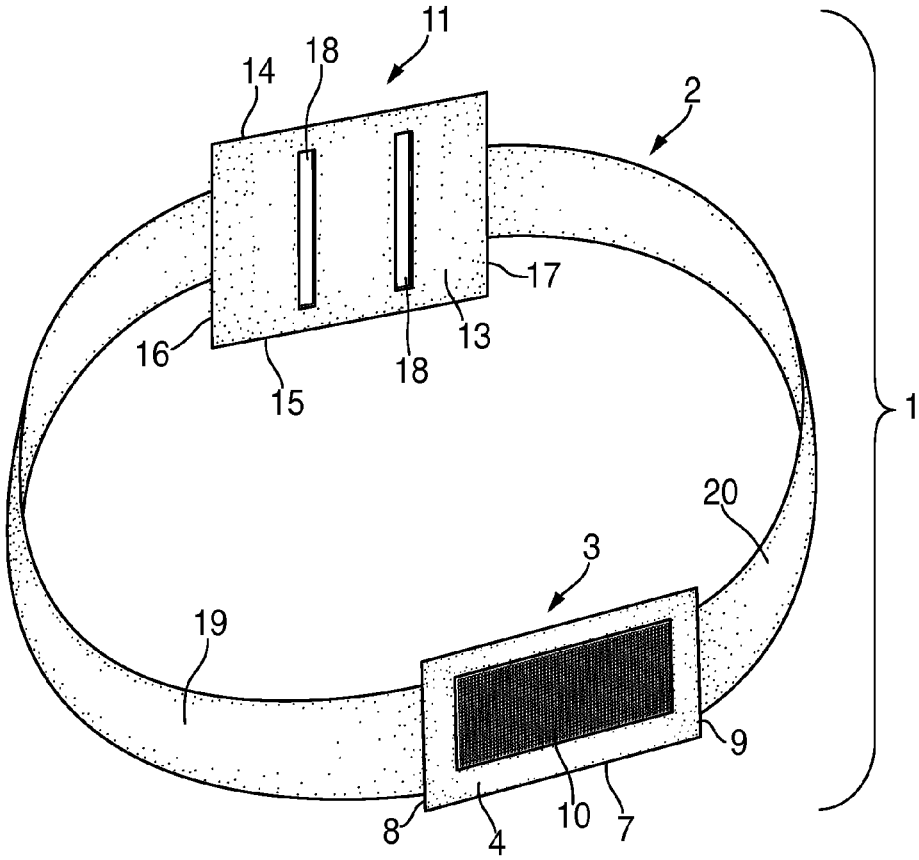
FIG. 4 provides a schematic perspective view of the first stage of the inventive clothing support system.
Figure 5:
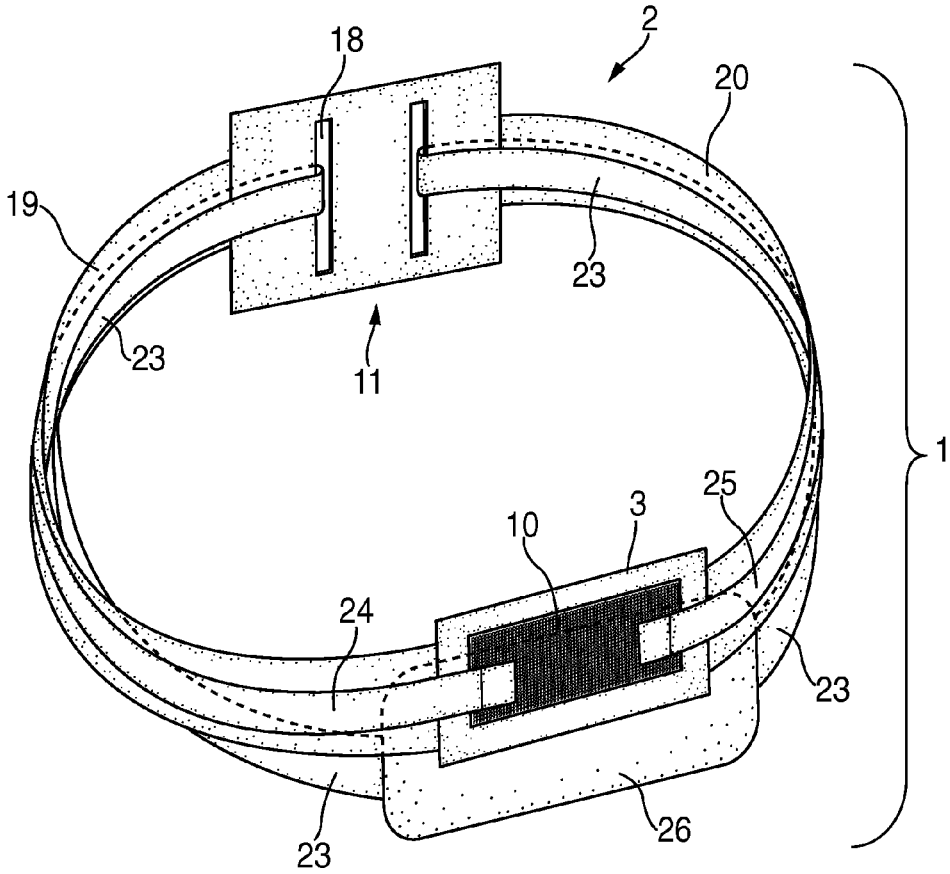
FIG. 5 provides a schematic perspective view of the first and second stages of the inventive clothing support system.

The present invention provides a clothing support system for providing support to at least a portion of a user's body. In certain embodiments, the clothing support system may serve as a maternity support article, thus providing uplifting support to the user's belly. The inventive clothing support system may be present in two configurations, or stages. The first configuration, or first stage, comprises a clothing support article as shown in FIG. 4. The clothing support article of the first configuration provides moderate support to at least a portion of a user's body via spring action, as described below. The second configuration, or second stage, of the clothing support system includes the clothing support article as described above, additionally in conjunction with a tension strap, as shown in FIG. 5. That is, the clothing support article is engaged with the tension strap to provide enhanced support as compared to the first stage alone. This is described in further detail below. An example of the second configuration in use as a maternity support is provided in FIG. 6.

As shown in FIGS. 1-6, the inventive clothing support system 1 first comprises a clothing support article 2. This clothing support article 2 comprises a front panel 3, shown in FIG. 1 as having an outer surface 4, an inner surface (not shown), a top edge 6, a bottom edge 7, a first side edge 8 and a second side edge 9. The front panel outer surface 4 comprises an attachment component 10. The attachment component 10 preferably comprises a device which is capable of attachment to the first end attachment component and second end attachment component of the tension strap, as described below. The attachment component 10 may comprise any suitable attachment device, nonexclusively including one or more of hook-and-loop fasteners, snaps, clips, hooks, buttons, and the like, and combinations thereof. In a preferred embodiment, the attachment component 10 comprises a hook-and-loop fastener.

Figure 1:
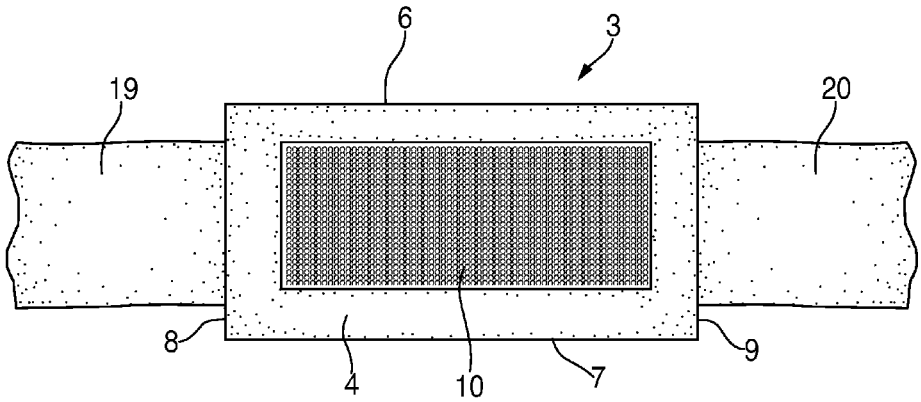
FIG. 1 provides a schematic view of a front panel of the present invention.
Figure 2:
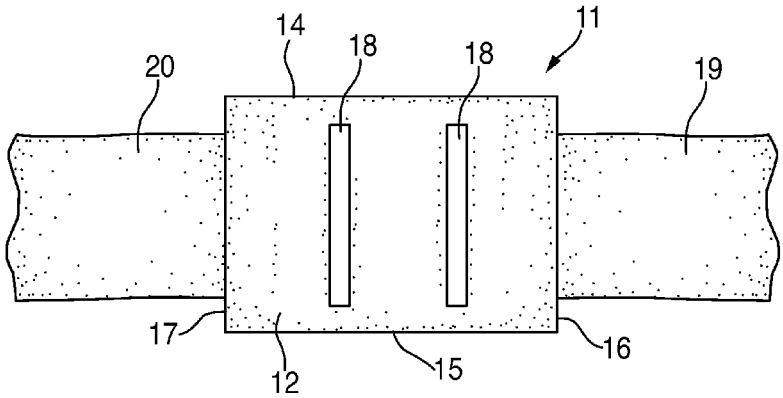
FIG. 2 provides a schematic view of a rear panel of the present invention.
Figure 3:
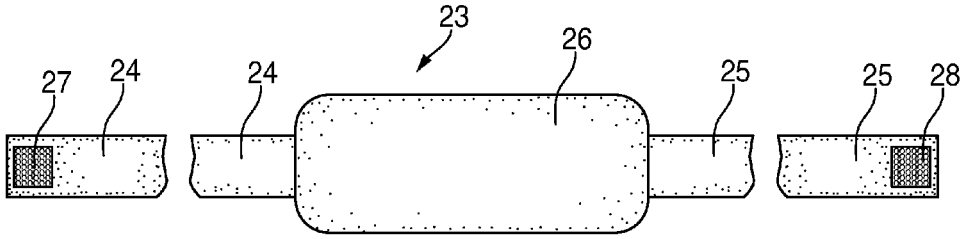
FIG. 3 provides a schematic view of a tension strap of the present invention.

This clothing support article 2 further comprises a rear panel 11, shown in FIG. 2 as having an outer surface 12, an inner 13, a top edge 14, a bottom edge 15, a first side edge 16 and a second side edge 17. The rear panel outer surface 12 comprises a rear engagement component 18. In certain embodiments, such as those shown in the FIGS., the rear engagement component may extend through the rear panel 11 such that it extends from the outer surface 12 to the inner surface 13. The rear engagement component 18 preferably comprises a feature which is capable of engaging the tension strap, as described below. The rear engagement component 18 preferably serves as a pivot point, through or around which the tension strap is pulled, to provide support to the body of a user wearing the inventive clothing support system. The rear engagement component 18 may comprise any suitable engagement device or means which serve as such a pivot point, nonexclusively including one or more of slits, slots, holes, belt loops, rings, D-rings, and the like. In a preferred embodiment, the rear engagement component 18 comprises slits through the rear panel 11. In a further embodiment, the rear engagement component 18 comprises two parallel vertical slits through the rear panel 11.

The front panel 3 and rear panel 11 each preferably comprise a substantially non-elastic fabric. The materials for the front panel and rear panel are selected independently, but preferably comprise the same or substantially the same materials. Suitable substantially non-elastic fabrics non-exclusively include woven materials formed from natural, synthetic, or cellulose fibers. Examples of such materials non-exclusively include one or more of cotton, polyesters, rayon, nylon, wool, and combinations and blends thereof, and other fabrics or textiles known in the art to be substantially non-elastic, and which are also suitable for clothing applications. In a preferred embodiment, the front panel 3 and rear panel 11 each comprise cotton.

The clothing support article 2 further comprises a first side panel 19 and a second side panel 20 as shown in FIGS. 1, 2, 3, and 5. The first and second side panels serve to attach the front panel 3 to the rear panel 11. The first side panel 19 is attached to the first side edge 8 of the front panel 3 and attached to the first side edge 16 of the rear panel 11. The second side panel 20 is attached to the second side edge 9 of the front panel 3, and attached to the second side edge 17 of the rear panel 11. It is preferred that the first side panel 19 and second side panel 20 each comprise a fabric of two-way elasticity which is laterally stretchable between the front panel and the rear panel. A key feature of this invention is that, when these components are attached to form the clothing support article 2, the two-way elasticity of the side panels and the substantially non-elastic fabric of the front and rear panels together produce a spring action which provides stability and support, via the clothing support article 2, to a user's body. This first configuration of this invention is useful during the early to middle stages of a maternity user's pregnancy.

As stated above, the first and second side panels each preferably comprise a fabric of two-way elasticity which is laterally stretchable between the front panel and the rear panel. Suitable materials for the fabric of two-way elasticity include stretch fabrics formed from elastomeric materials. It is known in the art that elastomeric materials generally have a low Young's modulus and high yield strain as compared with other materials. It is also known in the art that stretch fabrics are divided into two categories, namely those of two-way stretch and four-way stretch. Two-way stretch fabrics stretch in one direction, usually from selvedge to selvedge, while four-way stretch fabrics stretch in both directions, crosswise and lengthwise. The term two-way elasticity as used herein is intended to indicate a material of two-way stretch as known in the art.

The first and second side panel materials are selected independently, but preferably comprise the same or substantially the same materials. Suitable fabrics of two-way elasticity nonexclusively include elastomeric fabrics such as one or more of elastic, elastane, elastane blends, and combinations thereof, and other fabrics or textiles known in the art to be laterally stretchable, or of two-way stretch, and which are also suitable for clothing applications. In a preferred embodiment, the first side panel 19 and second side panel 20 each comprise elastic.

In certain embodiments, the clothing support article 2 further comprises an upper covering panel 21 attached to the top edge 6 of the front panel 3 and/or the top edge 14 of the rear panel 11 and/or a top edge of the side panels 19 and 20. In embodiments where the clothing support system is used for maternity support, the upper covering panel may be present as a belly covering or the like. The upper covering panel 21 may or may not provide additional support to the clothing support system. The upper covering panel 21 preferably a comprises a material of four-way elasticity which stretches laterally and longitudinally. As stated above, four-way stretch fabrics are known in the art to stretch in both directions. The term four-way elasticity as used herein is intended to indicate a material of four-way stretch as known in the art. Suitable materials for the upper covering panel nonexclusively include nylon, elastane, nylon-elastane blends, lycra, lycra blends, and other fabrics or textiles known in the art to be both laterally and longitudinally stretchable, or of four-way stretch, and which are also suitable for clothing applications. In a preferred embodiment, the upper covering panel 21 comprises a nylon-elastane blend.

In certain embodiments, the clothing support article 2 further comprises a border panel 22 attached to a top edge of the upper covering panel 21, or attached to the top edge 6 of the front panel 3 and/or the top edge 14 of the rear panel 11 and/or a top edge of the side panels 19 and 20. In embodiments where the clothing support system is used for maternity support, the upper covering panel may be present as a belly covering or the like. The border panel may serve as an area of enhanced elasticity at an edge or border of the clothing support article 2. The border panel 21 may comprise a material which is laterally and/or longitudinally stretchable as described above for other components of this invention. The border panel material may be the same or different from that of the upper covering panel as described above, or be formed of other fabrics or textiles known in the art to be laterally and/or longitudinally stretchable, and which are also suitable for clothing applications.

The second configuration, or second stage, of the clothing support system includes the above clothing support article 2 in conjunction with a tension strap 23, as shown in FIG. 5. That is, the clothing support article 2 is engaged with the tension strap 23, and provides enhanced support as compared to the first stage alone.

The tension strap 23 preferably comprises a substantially non-elastic fabric. Suitable substantially non-elastic fabrics non-exclusively include woven materials formed from natural, synthetic, or cellulose fibers. Examples of such materials non-exclusively include one or more of cotton, polyesters, rayon, nylon, wool, and combinations and blends thereof, and other fabrics or textiles known in the art to be substantially non-elastic, and which are also suitable for clothing applications. In a preferred embodiment, the tension strap comprises cotton. The tension strap 23 may or may not comprise the same material as the front panel 3 and/or rear panel 11 as described above. In certain embodiments the tension strap 23 may comprise a fabric of two-way elasticity which is laterally stretchable to some degree. As stated above, suitable fabrics of two-way elasticity nonexclusively include elastomeric fabrics such as one or more of elastic, elastane, elastane blends, and combinations thereof, and other fabrics or textiles known in the art to be laterally stretchable, or of two-way stretch, and which are also suitable for clothing applications. The tension strap 23 may or may not comprise the same material as the first and second side panels 19 and 20, as described above.

The tension strap 23 has a first end 24, a second end 25, and a central support portion 26. In use, the central support portion 26 is placed against a user's body to provide support, preferably uplifting support. This support may be provided when tension is applied to the tension strap 23 in use, as described below. In certain embodiments, the central support portion 26 may have a curved or contoured shape to provide enhanced uplifting support to a user's body. The central support portion 26 may be integral or continuous with the fabric of the first end 24 and the second end 25, or may comprise a panel which is attached, such as by sewing, to the first end 24 and second end 25. In certain embodiments, the central support portion 26 is placed between the clothing support article 2 and the user's body.

The first end 24 of the tension strap has an attachment component 27, and the second end 25 of the tension strap has an attachment component 28. Each of the first end attachment component 27 and second end attachment component 28 are capable of attachment to the attachment component 10 of the front panel 3. As such, each of said first end attachment component 27 and second end attachment component 28 comprise a suitable attachment device, nonexclusively including hook-and-loop fasteners, snaps, clips, hooks, buttons, and the like. In a preferred embodiment, the first end attachment component 27 and second end attachment component 28 each comprise hook-and-loop fasteners. In certain preferred embodiments, the first end attachment component 27 and second end attachment component 28 each comprise the male ends of such attachment devices while the attachment component 10 of the front panel 3 comprises a female end of such an attachment device. In other preferred embodiments, the first end attachment component 27 and second end attachment component 28 each comprise the female ends of such attachment devices while the attachment component 10 of the front panel 3 comprises a male of an attachment device.

In use, the tension strap 23 is engaged with the rear engagement component 18 of the rear panel 11. Such engaging may be done by any suitable means known to those in the art, and may be determined based on the type of engagement component chosen. As stated above, the rear engagement component 18 preferably serves as a pivot point, through or by which the tension strap may be pulled, to provide support to the body of a user of the inventive clothing support system. That is, a portion of the tension strap 23 is preferably pivoted, via the rear engagement component as discussed above, such that the ends of the tension strap 23 double back, or return to an opposite direction, to the front panel 3 of the clothing support article 2. For example, in an embodiment where the rear engagement component 18 of the rear panel 11 comprises a pair of slits, each of the first end 24 and the second end 25 of the tension strap 23 are inserted through the slits, which slits serve as a pivot point for the tension strap. Tension is then applied to the tension strap 23 such that a portion of the tension strap, such as the central support portion 26, provides support to a portion of a user's body. Such tension may be applied by any suitable means known to those in the art, such as pulling, and such means of applying tension may be determined by those of ordinary skill based on the type of engagement component chosen and the amount of support needed.

In a preferred embodiment, the tension strap 23 is pulled tightly against a portion of a user's body to provide tension and support to the user, by means of this second configuration of the clothing support system 4. In embodiments where the central support portion 26 is placed between the clothing support article 2 and the user's body, as stated above, a portion of the tension strap 23 is present between the clothing support article 2 and the user's body, that is, beneath the clothing support article 2 when worn by a user. In this embodiment, the ends 24, 25 of the tension strap 23 then engage the rear engagement component 18 such as by passing the ends 24, 25 of the tension strap 23 through a pair of slits of the rear engagement component 18, which serves as a pivot point, such that a portion of the tension strap 23 is then present on an outside of the clothing support article 2. In such an arrangement, the ends 24, 25 of the tension strap 23 are present on an outside of the side panels 19 and 20 in use. The ends 24, 25 of the tightly pulled tension strap 23 are then secured to the front panel 3. This is done by attaching the first end attachment component 27 and second end attachment component 28 of the tension strap 23 to the front panel attachment component 10, thereby providing support to at least a portion of the user's body.

As stated above, in certain arrangements, the ends 24, 25 of the tension strap 23 is present on an outside of the side panels 19 and 20 in use. In other arrangements, the ends 24, 25 of the tension strap 23 may be present on an inside of the side panels 19 and 20 when in use, wherein the first end 24 and the second end 25 of the tension strap 23 may be attachable to an attachment component 10 on an inside surface of the front panel 3, rather than the outside surface. In such embodiments, the rear engagement component 18 may also be present on an inside surface of the rear panel 11.

Figure 6:
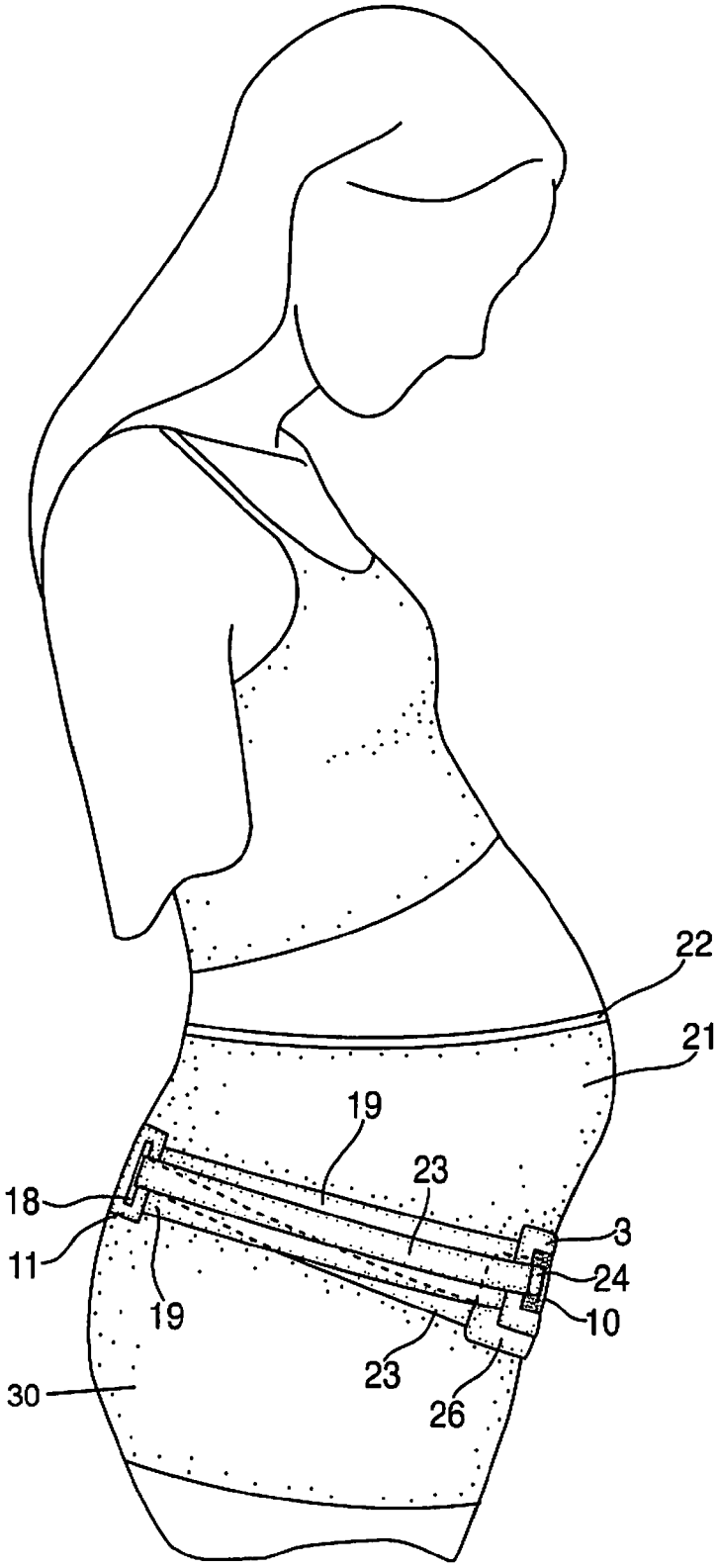
FIG. 6 provides a schematic view of the inventive clothing support system in use.

FIG. 6 provides one embodiment of this second configuration of the invention in use as a maternity support. In such use, the second configuration of the invention provides enhanced uplifting support, via the tension strap 23, as compared to the first configuration alone. Thus, this second configuration may be useful during the later stages of a maternity user's pregnancy.

The present invention may be used in variety of bodily support applications, and should not be limited by those described herein. In certain embodiments, the clothing support system of this invention provides support to a user's abdomen, such as for maternity support or obesity support. However, the inventive clothing support system is useful in various other support applications such as therapeutic support, geriatric support and the like. As such, the inventive clothing support system may be used for virtually any body part in need of support. Examples of such support applications nonexclusively include lumbar support, thoracic support, abdominal support, or support of shoulders, hips, arms, legs, or other extremities. The inventive system may be further used to position certain body parts for improved circulation.

The clothing support system of this invention, and its components, may be assembled and worn on their own, or may be attached to or incorporated into a support garment or the like. This may be done by sewing or by removably attaching the clothing support system to a support garment by any suitable means. Examples of such support garments include articles of clothing 30, nonexclusively including pants, jeans, shorts, skirts, undergarments, shirts, blouses, dresses, suits, sleepwear, active wear, sports wear, swimwear, and the like. Support garments may also include body braces or straps, and the like, which are worn in addition to clothing for injury support or other therapeutic support.

In use, the present invention provides method of providing support to a portion of a user's body. This method comprises the steps of:

I) providing a clothing support system, comprising a clothing support article as described above;

II) providing a tension strap as described above;

II) placing the central support portion of the tension strap against a user's body, III) engaging the tension strap with the rear engagement component of the rear panel; and IV) applying tension to the tension strap, and attaching the first end attachment component and second end attachment component of the tension strap to the front panel attachment component, thereby providing support to at least a portion of the user's body.

These steps are described in full detail above.

While the present invention has been particularly shown and described with reference to preferred embodiments, it will be readily appreciated by those of ordinary skill in the art that various changes and modifications may be made without departing from the spirit and scope of the invention. It is intended that the claims be interpreted to cover the disclosed embodiment, those alternatives which have been discussed above and all equivalents thereto.

What is claimed is:

1. A clothing support garment for providing support to a user's body, said clothing support garment comprising a clothing support article which comprises:

a) a front panel having an outer surface, an inner surface, a top edge, a bottom edge, a first side edge and a second side edge, said front panel comprising a substantially non-elastic fabric, and which front panel outer surface comprises an attachment component;

b) a rear panel having an outer surface, an inner surface, top edge, a bottom edge, a first side edge and a second side edge, said rear panel comprising a substantially non-elastic fabric, and which rear panel outer surface comprises a rear engagement component; and c) a first side panel attached to the first side edge of the front panel and attached to the first side edge of the rear panel; a second side panel attached to the second side edge of the front panel and attached to the second side edge of the rear panel; said first side panel and second side panel each comprising a fabric of two-way elasticity which is laterally stretchable between the front panel and the rear panel.

2. The clothing support garment of claim 1 which further comprises a tension strap having a first end, a second end, and a central support portion which tension strap comprises a substantially non-elastic fabric; the first end of the tension strap having an attachment component, and the second end of the tension strap having an attachment component; the tension strap being engageable with the rear engagement component of the rear panel; the first end attachment component and second end attachment component of the tension strap, each being attachable to the attachment component of the front panel.

3. The clothing support garment of claim 1 wherein the clothing support article further comprises an upper covering panel attached to the top edge of the front panel and/or the top edge of the rear panel, which upper covering panel is designed to cover a part of a user's body.

4. The clothing support garment of claim 1 wherein the attachment component of the front panel comprises one or more of hook-and-loop fasteners, snaps, clips, hooks, buttons.

5. The clothing support garment of claim 2 wherein the attachment component of the front panel, the first end attachment component of the tension strap, and the second end attachment component of the tension strap each comprise one or more of hook-and-loop fasteners, snaps, clips, hooks, buttons.

6. The clothing support garment of claim 1 wherein the rear engagement component comprises one or more of slits, slots, holes, belt loops, rings, and D-rings.

7. The clothing support garment of claim 1 wherein the front panel and the rear panel each independently comprise a substantially non-elastic fabric that comprises one or more of cotton, polyesters, rayon, nylon, wool, and combinations or blends thereof.

8. The clothing support garment of claim 2 wherein the front panel, the rear panel, and the tension strap each independently comprise a substantially non-elastic fabric which comprises one or more of cotton, rayon, polyesters, rayon, nylon, wool, and combinations or blends thereof.

9. The clothing support garment of claim 1 wherein the first side panel and the second side panel each comprise a fabric of two-way elasticity which is laterally stretchable, and wherein said fabric comprises one or more of elastic, elastane, elastane blends, and combinations thereof.

10. An article of clothing comprising the clothing support garment of claim 1.

11. An article of clothing comprising the clothing support garment of claim 2.

12. An article of clothing comprising the clothing support garment of claim 3.

13. The article of clothing of claim 10 which comprises pants.

14. The article of clothing of claim 10 which comprises an undergarment.

15. A method of providing support to a portion of a user's body, comprising the steps of:

I) providing a clothing support garment comprising a clothing support article which comprises:

a) a front panel having an outer surface, an inner surface, a top edge, a bottom edge, a first side edge and a second side edge, said front panel comprising a substantially non-elastic fabric, and which front panel outer surface comprises an attachment component;

b) a rear panel having an outer surface, an inner surface, top edge, a bottom edge, a first side edge and a second side edge, said rear panel comprising a substantially non-elastic fabric, and which rear panel outer surface comprises a rear engagement component; and c) a first side panel attached to the first side edge of the front panel and attached to the first side edge of the rear panel; a second side panel attached to the second side edge of the front panel and attached to the second side edge of the rear panel; said first side panel and second side panel each comprising a fabric of two-way elasticity which is laterally stretchable between the front panel and the rear panel;

II) providing a tension strap having a first end, a second end, and a central support portion which tension strap comprises a substantially non-elastic fabric; the first end of the tension strap having an attachment component, and the second end of the tension strap having an attachment component; the tension strap being engageable with the rear engagement component of the rear panel; the first end attachment component and second end attachment component of the tension strap each being attachable to the attachment component of the front panel;

III) placing the central support portion of the tension strap against a user's body, IV) engaging the tension strap with the rear engagement component of the rear panel; and V) applying tension to the tension strap, and attaching the first end attachment component and second end attachment component of the tension strap to the front panel attachment component, thereby providing support to at least a portion of the user's body.

16. The method of claim 15 wherein the clothing support article further comprises an upper covering panel attached to a top edge of the front panel and/or a top edge of the rear panel, which upper covering panel is designed to cover a part of a user's body.

17. A clothing support garment for providing support to a user's body, said clothing support garment comprising a clothing support article which comprises:

a) a front panel having an outer surface, an inner surface, a top edge, a bottom edge, a first side edge and a second side edge, said front panel comprising a substantially non-elastic fabric, and which front panel outer surface comprises an attachment component;

b) a rear panel having an outer surface, an inner surface, top edge, a bottom edge, a first side edge and a second side edge, said rear panel comprising a substantially non-elastic fabric, and which rear panel outer surface comprises a rear engagement component;

c) a first side panel attached to the first side edge of the front panel and attached to the first side edge of the rear panel; a second side panel attached to the second side edge of the front panel and attached to the second side edge of the rear panel; said first side panel and second side panel each comprising a fabric of two-way elasticity which is laterally stretchable between the front panel and the rear panel; and d) an upper covering panel attached to the top edge of the front panel and/or the top edge of the rear panel, which upper covering panel is designed to cover a part of a user's body;

wherein the attachment component of the front panel comprises hook-and-loop fasteners;

wherein the rear engagement component of the rear panel comprises hook-and-loop fasteners;

wherein the front panel and the rear panel each independently comprise a substantially non-elastic fabric comprising cotton; and wherein the first side panel and the second side panel each independently comprise a fabric of two-way elasticity which is laterally stretchable, said fabric comprising elastic.

18. The clothing support garment of claim 17 which further comprises a tension strap having a first end, a second end, and a central support portion which tension strap comprises a substantially non-elastic fabric; the first end of the tension strap having an attachment component, and the second end of the tension strap having an attachment component; the tension strap being engageable with the rear engagement component of the rear panel; the first end attachment component and second end attachment component of the tension strap each being attachable to the attachment component of the front panel;

wherein the tension strap comprises a substantially non-elastic fabric comprising cotton; and wherein the first end attachment component and second end attachment component of the tension strap comprise hook-and-loop fasteners.

19. An article of clothing comprising the clothing support garment of claim 17.

20. An article of clothing comprising the clothing support garment of claim 18.

* * * * *